US007802545B2

(12) United States Patent
Mizuno

(10) Patent No.: US 7,802,545 B2
(45) Date of Patent: Sep. 28, 2010

(54) VALVE TIMING CONTROLLER

(75) Inventor: Daisuke Mizuno, Kariya (JP)

(73) Assignee: Denso Corporation, Karyia (JP)

( * ) Notice: Subject to any disclaimer, the term of this patent is extended or adjusted under 35 U.S.C. 154(b) by 553 days.

(21) Appl. No.: 11/826,892

(22) Filed: Jul. 19, 2007

(65) Prior Publication Data

US 2008/0051980 A1 Feb. 28, 2008

(30) Foreign Application Priority Data

Aug. 25, 2006 (JP) ..... 2006-229699

(51) Int. Cl.
*F01L 1/34* (2006.01)

(52) U.S. Cl. ..... 123/90.15; 123/90.17; 123/347; 318/268

(58) Field of Classification Search ..... 123/90.15, 123/90.16, 90.17, 90.18, 347, 348; 318/245, 318/268, 434

See application file for complete search history.

(56) References Cited

U.S. PATENT DOCUMENTS 7,146,944 B2 12/2006 Tani et al.
7,148,640 B2 * 12/2006 Tani ..... 318/280

FOREIGN PATENT DOCUMENTS

| | | |
|---|---|---|
| JP | 05-22979 | 1/1993 |
| JP | 2001-022417 | 1/2001 |
| JP | 2005-120874 | 5/2005 |

* cited by examiner

*Primary Examiner*—Ching Chang
(74) *Attorney, Agent, or Firm*—Nixon & Vanderhye, PC

(57) ABSTRACT

A valve timing controller has the drive circuit which performs a feedback control of the energization to the electric motor based on the target rotation speed and the actual rotation speed of the electric motor, and rotates the electric motor to the target rotation direction. An invalid switch part of the drive circuit suspends the feedback control at the time of change of the target rotation direction.

9 Claims, 11 Drawing Sheets

| | INSTRUCTION FLAG |
|---|---|
| HOLD OF TARGET DIRECTION | ON |
| CHANGE OF TARGET DIRECTION | OFF |

FIG. 12

| | TARGET ROTATION DIRECTION | TACTUAL ROTATION DIRECTION | FEEDBACK CORRECTION VALUE | ENERGIZATION INSTRUCTION VALUE |
|---|---|---|---|---|
| HOLD OF TARGET DIRECTION | NORMAL | NORMAL | $G\cdot(Rt-Rr)$ | $A\cdot Rt+B+G\cdot(Rt-Rr)$ |
| | REVERSE | REVERSE | $G\cdot\{(-Rt)-(-Rr)\}$ | $A\cdot(-Rt)-B+G\cdot\{(-Rt)-(-Rr)\}$ |
| CHANGE OF TARGET DIRECTION | NORMAL | NORMAL | $G\cdot\{Rt-(-Rr)\}+2B\cdot G/A$ | $A\cdot Rt+B$ |
| | REVERSE | REVERSE | $G\cdot\{(-Rt)-Rr\}-2B\cdot G/A$ | $A\cdot(-Rt)-B$ |

VALVE TIMING CONTROLLER

CROSS-REFERENCE TO RELATED APPLICATION

This application is based on Japanese Patent Application No. 2006-229699 filed on Aug. 25, 2006, the disclosure of which is incorporated herein by reference.

FIELD OF THE INVENTION

The present invention relates to a valve timing controller which adjusts valve timing of at least one of an intake valve and an exhaust valve by energizing an electric motor in a normal direction or a reverse direction.

BACKGROUND OF THE INVENTION

JP-2005-120874A (U.S. Pat. No. 7,146,944B2) shows an electric valve timing controller equipped with a drive circuit which controls the energization to the electric motor based on a target rotation speed and an actual rotation speed of the electric motor so as to rotates the electric motor to a target rotation direction.

JP-5-22979A indicates a well known technology in which the electric motor rotates in one way direction. However, it is difficult to apply this technology to the electric valve timing controller which rotates the electric motor to a normal rotation direction and a reverse rotation direction.

A research has been was conducted under the above background about the electric valve timing controller which rotates the electric motor in both directions, and the technology which performs feedback control of the energization to the electric motor using the map shown in FIG. 13A is developed.

Specifically in this technology, a difference is computed by converting the target rotation speed and the actual rotation speed on individual map. The energization instruction value of the electric motor is determined based on this difference value. As shown in FIG. 13A, a map used for conversion of the target rotation speed and the actual rotation speed defines the conversion relationship which offsets the output y representing the normal direction and the reverse direction with respect to an input rotation speed x of the zero value. Here, the offset in the map is established based on the following reason. In a valve timing controller provided with an electric motor, the electric motor is driven in the same direction or the reverse direction as the rotation direction of the engine in order to adjust the valve timing. While the valve timing is maintained, the electric motor is driven in the normal rotation direction as the same speed as the internal combustion engine. In order to prevent the situation where the actual rotation speed of the electric motor shifts from the target rotation speed by friction loss during this period, it is necessary to always perform a certain amount of energization to the electric motor.

According to the further study about the technology which uses the map, the following problem is found. When changing the target rotation direction and making it differ from the actual rotation direction, the amount of energization corresponding to the sum of offset amount $\Delta$ of the output y is superfluously needed, so that energy consumption increases. Then, it is considered that a map with the offset and a map without offset as shown in FIG. 13B are respectively used between a case where the target rotation direction is unchanged and a case where the target rotation direction is changed. However, it is apparent that the drive circuit is complicated.

The present invention is made in view of such a problem, and an object of the present invention is to provide an electric valve timing controller which simplifies processing required for rotation of the electric motor.

SUMMARY OF THE INVENTION

According to the present invention, the drive circuit which performs feedback control of the energization to the electric motor based on a target rotation speed and an actual rotation speed of the electric motor so as to rotate the electric motor to the target rotation direction. When changing the target rotation direction, the drive circuit stops the feedback control. According to this structure, it is enough just to stop feedback control at the time of change of the target rotation direction.

Therefore, the processing required for rotation of the electric motor at the time of valve timing adjustment can be simplified. Furthermore, since the frequency where the target rotation direction is changed is less than the frequency where the target rotation direction is held, an influence due to termination of the feedback control is restrained.

BRIEF DESCRIPTION OF THE DRAWINGS

FIG. 12 is a chart for explaining the operation of the control block.

DETAILED DESCRIPTION OF THE PREFERRED EMBODIMENTS

Figure 1:
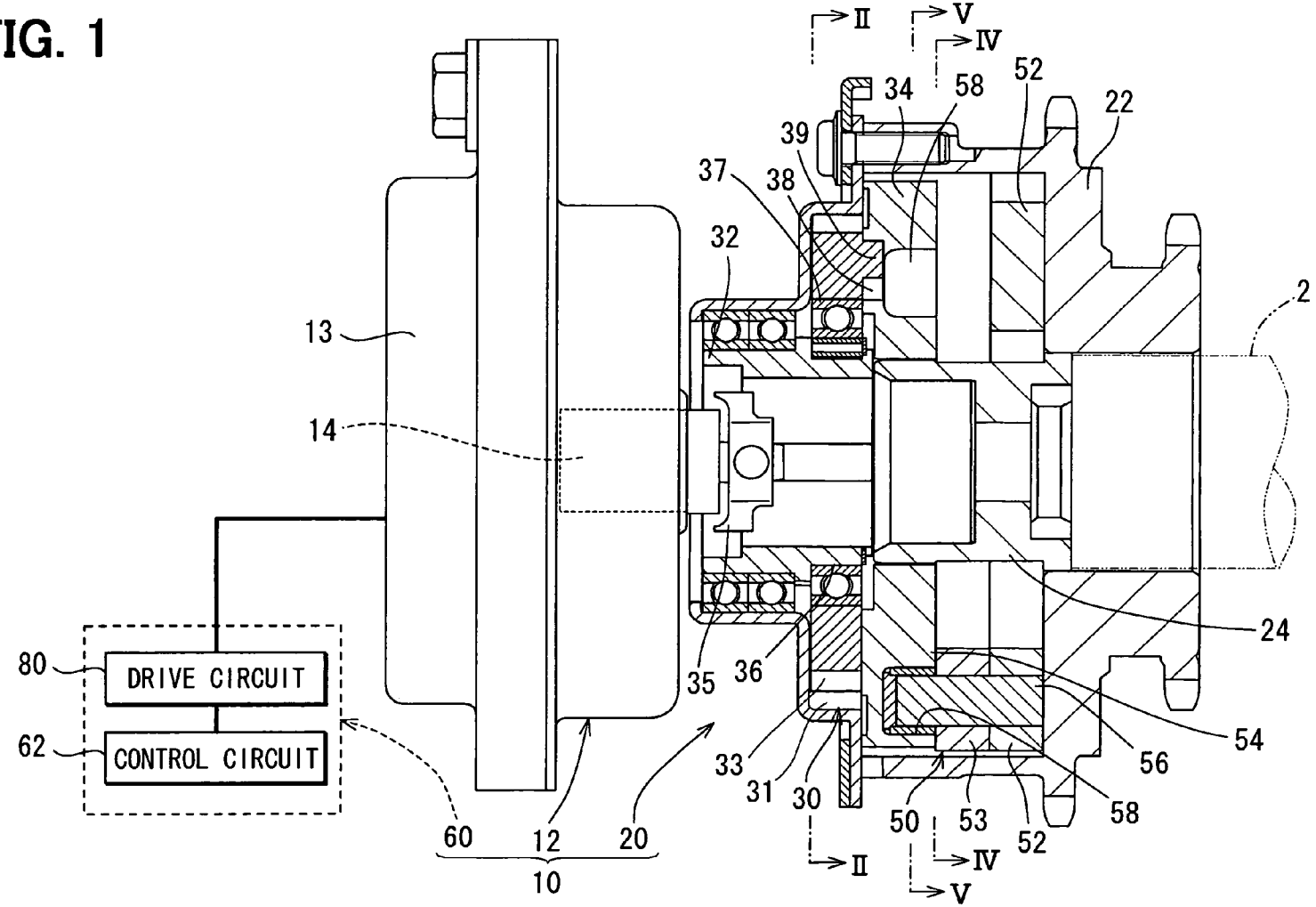
FIG. 1 is a cross sectional view showing a valve timing controller, taken along a line I-I in FIG. 4.

FIG. 1 is a cross sectional view of a valve timing controller 1. The valve timing controller 10 is provided in a torque transfer system which transfers the torque of a crankshaft (not shown) to a camshaft 2 of an engine. The valve timing controller 10 adjusts a valve timing of an intake valve or an exhaust valve by use of an electric motor 12.

The electric motor 12 is a brushless motor having a motor case 13, a motor shaft 14 and a coil (not shown). The motor case 13 is fixed on the engine through a stay (not shown). The motor case 13 supports the motor shaft 14 and accommodates the coil therein. When the coil of the motor 12 is energized, a rotating magnetic field is generated in a clockwise direction to rotate the motor shaft 14 in a normal direction. When the coil is energized to generate the rotating magnetic filed in counterclockwise direction, the motor shaft 14 is rotated in a reverse direction.

Figure 3:
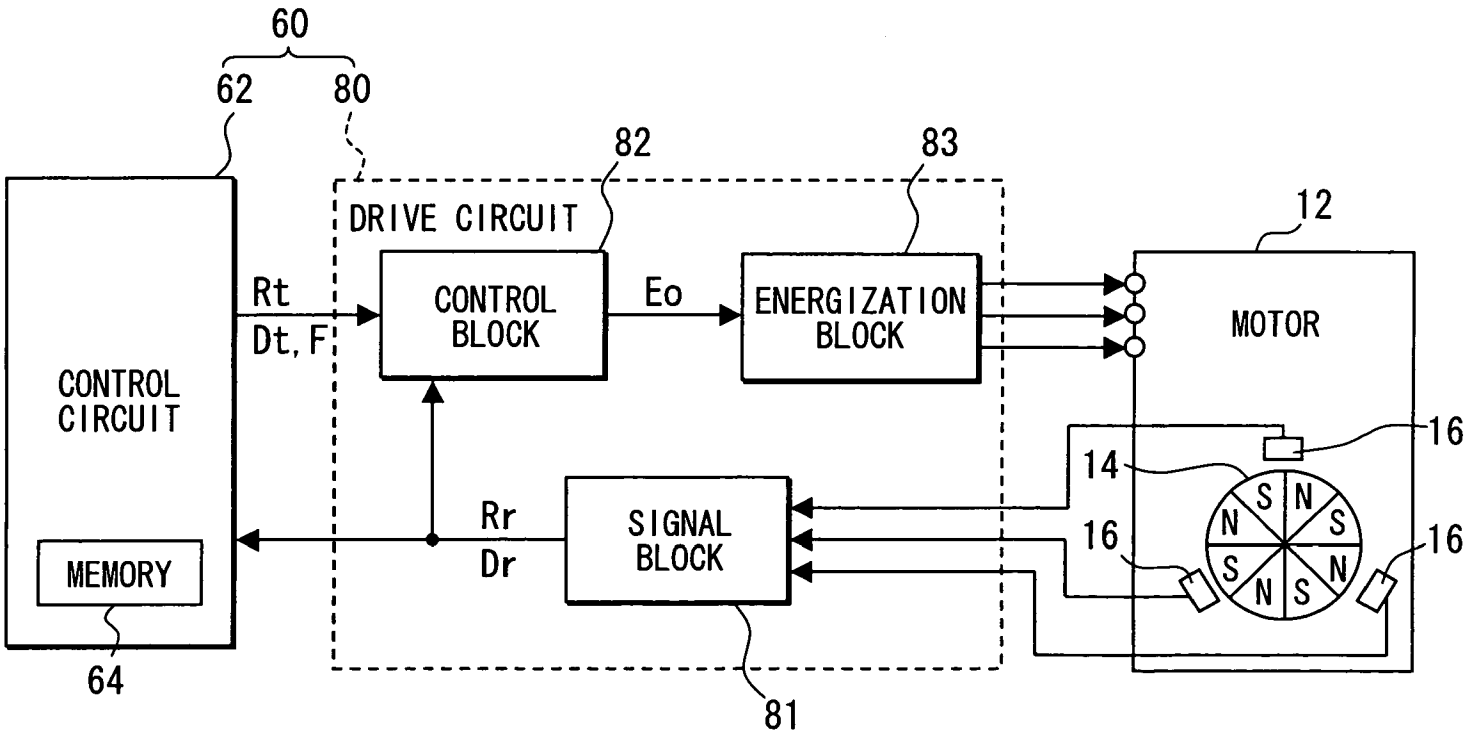
FIG. 3 is a block diagram showing an electric circuit.

As shown in FIG. 3, the electric motor 12 is provided with rotation angle sensors 16. The rotation angle sensors 16 are Hall elements that are arranged around the motor shaft 14 at regular intervals. The rotation angle sensors 16 output sensor-signals of which voltage level is varied according to a rotational position of magnetic poles N, S of the motor shaft 14.

Referring to FIG. 1, a phase-change unit 20 will be described hereinafter. The phase-change unit 20 includes a drive-rotation member 22, a driven-rotation member 24, a differential gear mechanism 30, and a link mechanism 50.

The drive-rotation member 22 is a timing sprocket around which a timing chain is wound to receive a driving force from a crankshaft of the engine. The drive-rotation member 22 rotates in accordance with the crankshaft in the clockwise direction in FIG. 4, while maintaining the same rotational phase as the crankshaft. The driven-rotation member 24 is coaxially fixed to the camshaft 2 and rotates in the clockwise direction along with the camshaft 2. The normal direction of the motor shaft 14 is the same as the rotation direction of the engine, and the reverse direction of the motor shaft 14 is counter to the rotation direction of the engine.

Figure 2:
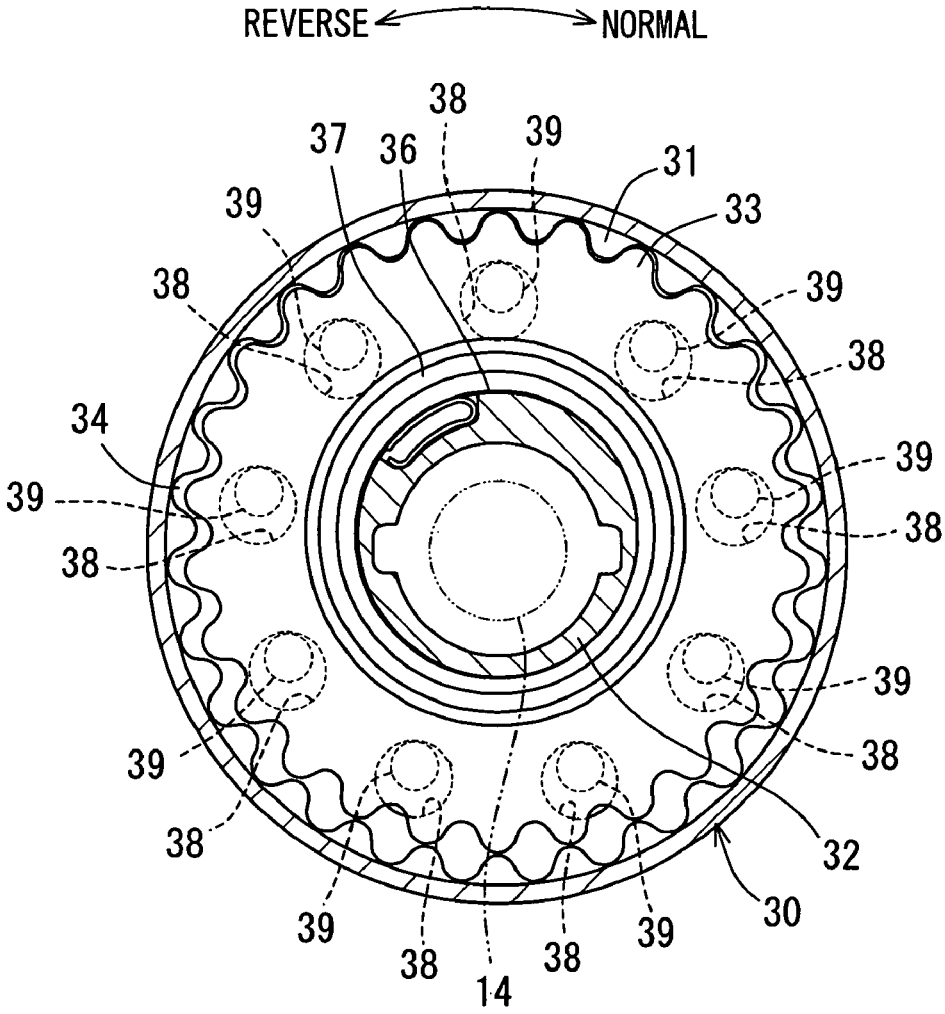
FIG. 2 is a cross sectional view taken along a line II-II in FIG. 1.

As shown in FIGS. 1 and 2, the differential gear mechanism 30 includes a sun gear 31, a planetary carrier 32, a planetary gear 33, and a guide-rotation member 34. The sun gear 31 is an internal gear, which is coaxially fixed to drive-rotation member 22, and rotates along with the drive-rotation member 22 by receiving an output torque of the crankshaft. The planetary carrier 32 is connected to the motor shaft 14 through a joint 35 to rotate along with the motor shaft 14 by receiving the rotation torque from the motor shaft 14. The planetary carrier 32 has an eccentric portion 36 of which outer surface is eccentric with respect to the drive-rotation member 22. The planetary gear 33 is an external gear which is engaged with the eccentric portion 36 through a bearing 37, so that the planetary gear 33 is eccentric with respect to the sun gear 31. The planetary gear 33 engages with the sun gear 31 from its internal side, and performs a planetary motion in accordance with a relative rotation of the motor shaft 14 with respect to the drive-rotation member 22. The guide-rotation member 34 coaxially engages with an outer surface of the driven-rotation member 24. The guide-rotation member 34 is provided with a plurality of engaging holes 38 which are arranged in the rotation direction at regular intervals. The planetary gear 33 is provided with a plurality of engaging protrusions 39 which are engaged with the engaging holes 38, so that a rotational movement of the planetary gear 33 is converted into the rotational movement of the guide-rotation member 34.

Figure 4:
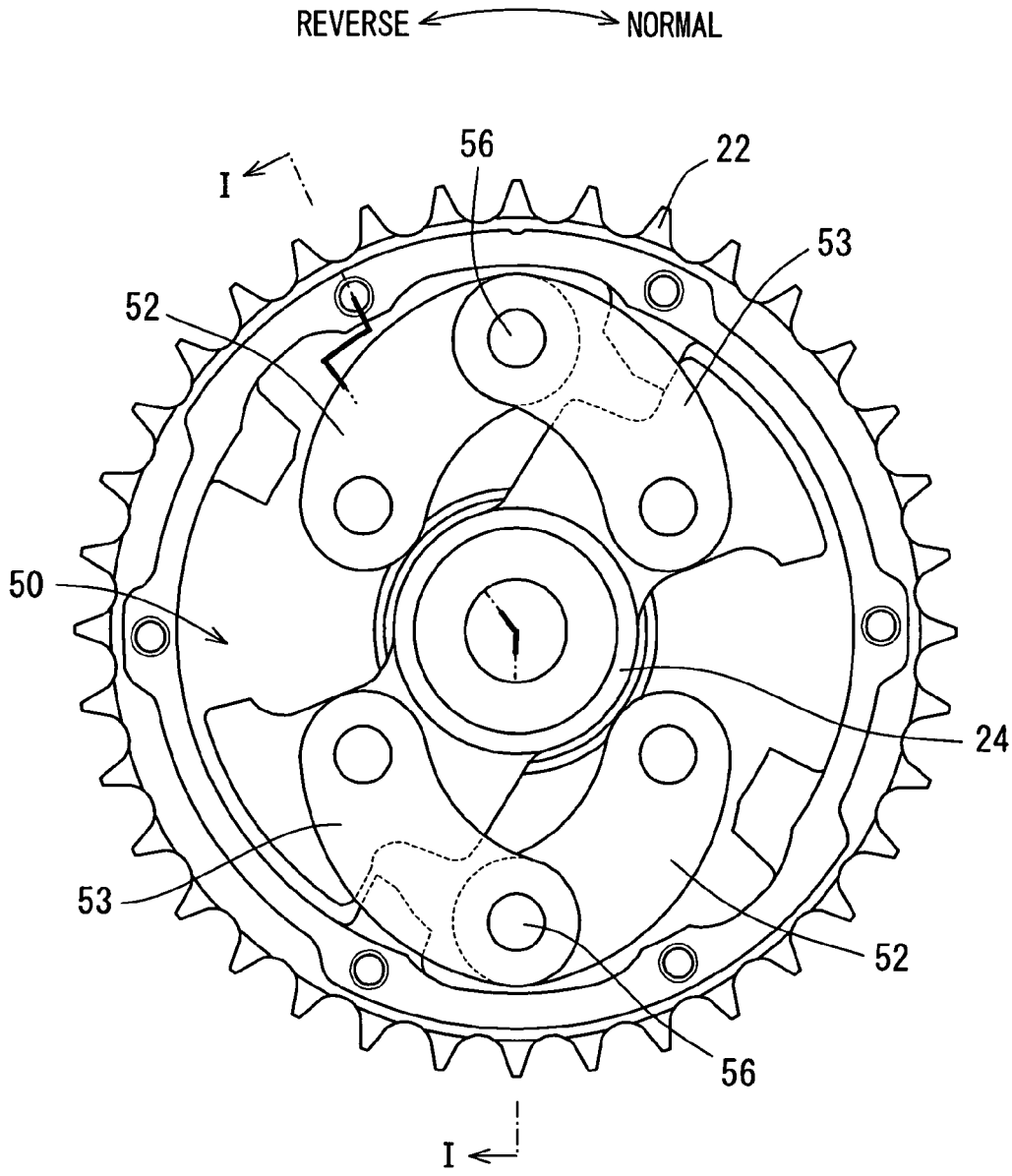
FIG. 4 is a cross sectional view taken along a line IV-IV in FIG. 1.
Figures 5, 6:
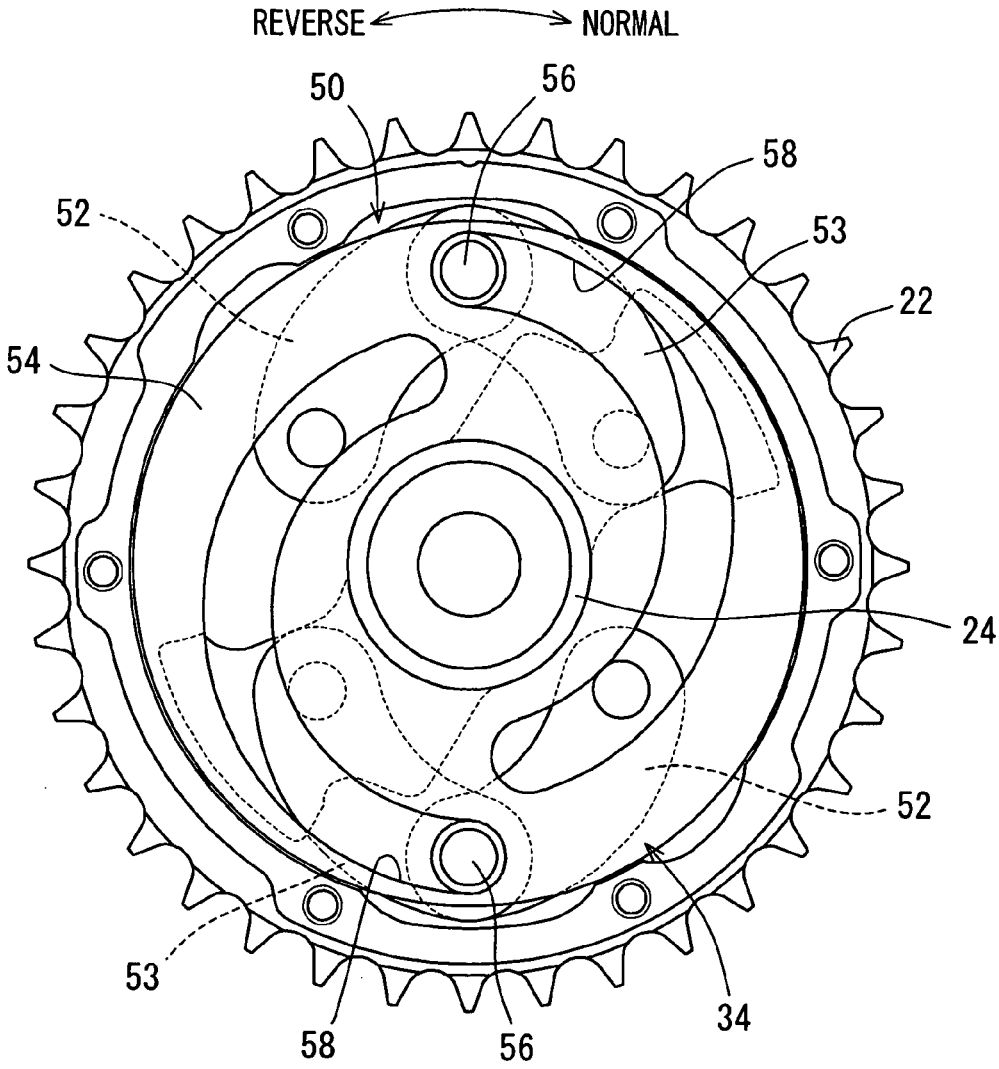
FIG. 5 is a cross sectional view taken along a line V-V in FIG. 1.
FIG. 6 is a chart showing a relationship between a target rotation direction and an instruction flag.

As shown in FIGS. 4 and 5, the link mechanism 50 includes a first link 52, a second link 53, a guide portion 54, and a movable member 56. In FIGS. 4 and 5, hatching showing cross sections are not illustrated. The first link 52 is connected to the drive-rotation member 22 by a revolute pair. The second link 53 is connected to the driven-rotation member by a revolute pair and is connected to the first link 52 through the movable member 56. As shown in FIGS. 1 and 5, the guide portion 54 is formed in the guide-rotation member 34 at a side opposite to the planetary gear 33. The guide portion 54 is provided with guide grooves 58 in which the movable member 56 slides. The guide grooves 58 are spiral grooves such that the distance from the rotation center varies along its extending direction.

In a case that the motor shaft 14 does not relatively rotate with respect to the drive-rotation member 22, the planetary gear 33 does not perform the planetary motion so that the drive-rotation member 22 and the guide-rotation member 34 rotates together. As the result, the movable member 56 does not move in the guide groove 58 and the relative position between the first link 52 and the second link 53 does not change, so that the relative rotational phase between the drive-rotation member 22 and the driven-rotation member 24 is maintained, that is, the instant valve timing is maintained. Meanwhile, in a case that the motor shaft 14 relatively rotates with respect to the drive-rotation member 22 in the clockwise direction, the planetary gear 33 performs the planetary motion so that the guide-rotation member 34 relatively rotates with respect to the drive-rotation member 22 in the counterclockwise direction in FIG. 5. As the result, the relative position between the first link 52 and the second link 53 is varied, and the driven-rotation member 24 relatively rotates with respect to the drive-rotation member 22 in the clockwise direction so that the valve timing is advanced. In a case that the motor shaft 14 relatively rotates in the counterclockwise direction, the valve timing is retarded.

A period during which the electric motor 12 rotates in the reverse direction is longer than a period during which the electric motor 12 rotates in the normal direction.

Referring to FIG. 3, an electric circuit 60 will be described hereinafter. The electric circuit 60 includes a control circuit 62 and a drive circuit 80. The control circuit 62 is connected to the drive circuit 80 through signal lines 63, 64, 65. The control circuit 62 receives a rotation-direction signal and a rotation-speed signal through the signal lines 63, 64, 65. The rotation-direction signal represents an actual rotation direction D of the motor 12, and the rotation-speed signal represents an actual rotation speed R of the motor 12. The control circuit 62 calculates an actual valve timing based on the rotation-direction signal and the rotation-speed signal, and sets a target valve timing based on the throttle position, an oil temperature, and the like. Furthermore, the control circuit 62 determines a target rotation direction "d" and a target rotation speed "r" of the electric motor 12 based on a differential phase between the actual valve timing and the target valve timing, and generates control signals indicative of "d" and "r". The control signals are transmitted from the control circuit 62 into to the drive circuit 80 through the signal line 65.

As shown in FIG. 3, the control circuit 62 is configured to include a microcomputer with a memory 64. The control circuit 62 connects with the drive circuit 80, and receives an actual rotation speed Rr and an actual rotation direction Dr of the electric motor 12 from the drive circuit 80. The control circuit 62 performs the predetermined control routine for every control timing by executing the program stored in the memory 64.

Specifically, in the control routine, an actual valve timing is calculated based on the actual rotation speed Rr and the actual rotation direction Dr, and a target valve timing is established based on engine information, such as throttle position and the like. Then, the target rotation speed Rt and target rotation direction Dt of the electric motor 12 are respectively established from the phase difference of the actual valve timing and the target valve timing. Furthermore, it is determined whether the instant target rotation direction Dt is held to the target rotation direction Dt established at the last control timing, or it is changed. As a result, as shown in FIG. 6, when it is determined that the last target rotation direction is hold as the instant target rotation direction Dt, an instruction flag F stored fin the memory 64 is turned ON. When it is determined that the target rotation direction Dt has been changed, the instruction flag F is turned OFF. Besides, in the present embodiment, since the drive circuit 80 establishes the actual rotation direction Dr based on the target rotation direction Dt, when the target rotation direction Dt is held, the direction Dt and Dr are in agreement. Meanwhile, when the target rotation direction Dt is changed, the direction Dt and Dr are different from each other.

Figure 7:
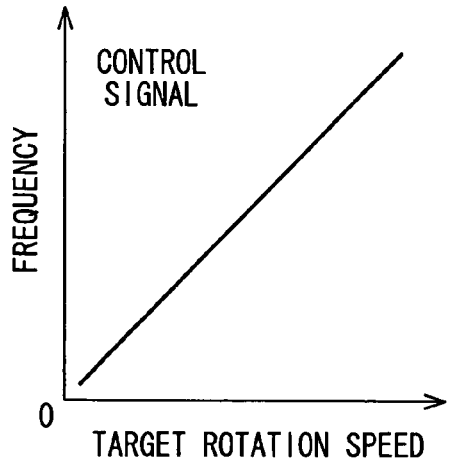
FIG. 7 is a graph showing a relationship between a target rotation speed and a frequency of the control signal.
Figure 8:
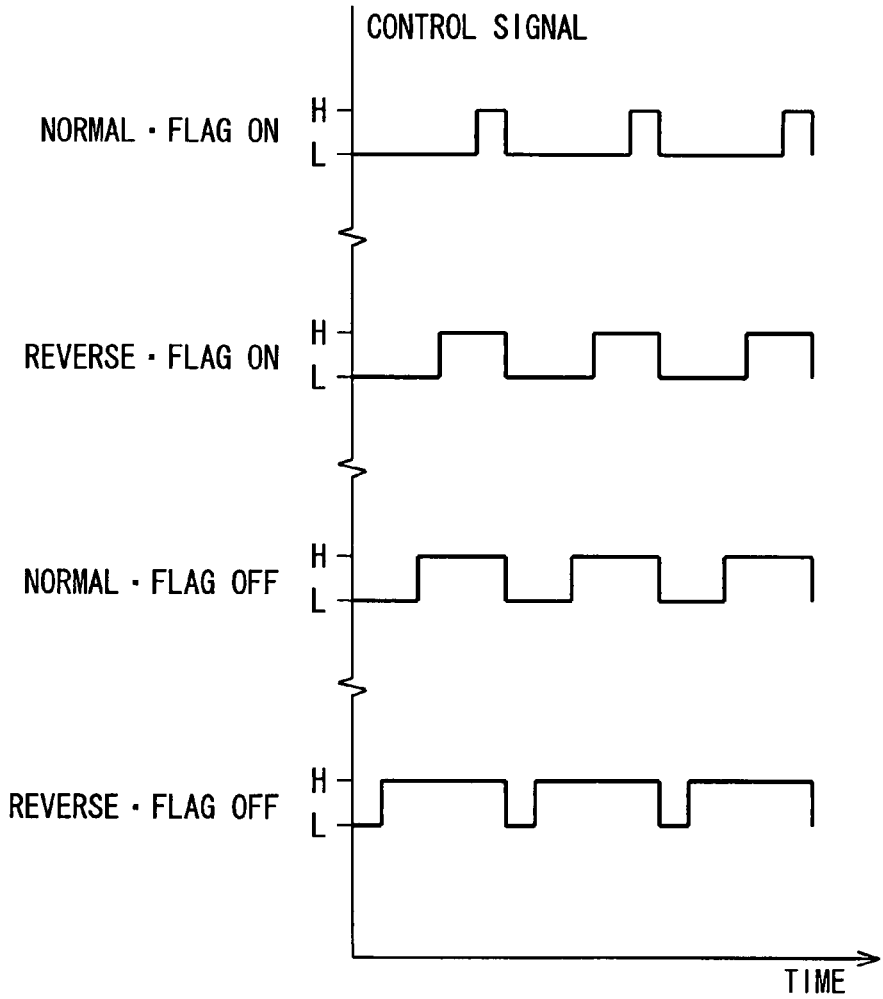
FIG. 8 is a diagram showing a relationship between a combination of a target rotation direction and an instruction flag, and the duty ratio of the control signal.

In the control program of the control circuit 62, the target rotation speed Rt, the target rotation direction Dt, and the setting status of the instruction flag F are expressed by the control signal. The control signal is inputted into the drive circuit 80. At the present embodiment, the control signal expresses the target rotation speed Rt with frequency, and expresses the target rotation direction Dt and the instruction flag F with the duty ratio. Therefore, the frequency of the control signal and the target rotation speed Rt have a linear relation as shown in FIG. 7. Moreover, the duty ratio of the control signal changes according to the combination of the target rotation direction Dt and the setting status of the instruction flag F. Namely, as shown in FIG. 8, the duty ratio of the control signal has a different value respectively between a case when the target rotation direction Dt is the normal rotation direction and the instruction flag F is ON, a case when the target rotation direction Dt is the reverse rotation direction and the instruction flag F is ON, a case when the target rotation direction Dt is the normal rotation direction and the instruction flag F being OFF, and a case when the target rotation direction Dt is the reverse rotation direction and the instruction flag F is OFF.

As shown in FIG. 3, the drive circuit 80 is provided with a signal generation block 81, a control block 82, and an energization block 83. Besides, each block 81-83 is constituted by the circuit elements.

The signal generation block 81 is connected to each rotational angle sensor 16 of the electric motor 12, the control circuit 62, and control block 82. The signal generation block 81 calculates the actual rotation speed Rr and actual rotation direction Dr of the electric motor 12 based on the sensor signals from each rotational angle sensor 16, and inputs them into the control circuit 62 and the control block 82.

The control block 82 is connected to the control circuit 62, the signal generation block 81, and the energization block 83. The control block 82 determines the energization instruction value Eo to be inputted into energization block 83 based on the target rotation speed Rt, the target rotation direction Dt and instruction flag F which are transmitted from the control circuit 62*t*, and the actual rotation speed Rr and actual rotation direction Dr which are transmitted from the signal generation block 81.

In the present embodiment, the energization instruction value Eo is the command value for performing a feedback control of the electric motor 12, or the command value for performing an open loop control thereof. Here, the energization instruction value Eo for performing the feedback control is determined based on the target rotation speed Rt, the target rotation direction Dt, the actual rotation speed Rr, and the actual rotation direction Dr at the time when the instruction flag F is ON, i.e., the target rotation direction Dt is hold. Meanwhile, the energization instruction value Eo for performing the open loop control is determined based on the target rotation speed Rt and the target rotation direction Dt at the time when the instruction flag F is OFF, i.e., the target rotation direction Dt is changed.

Figure 9:
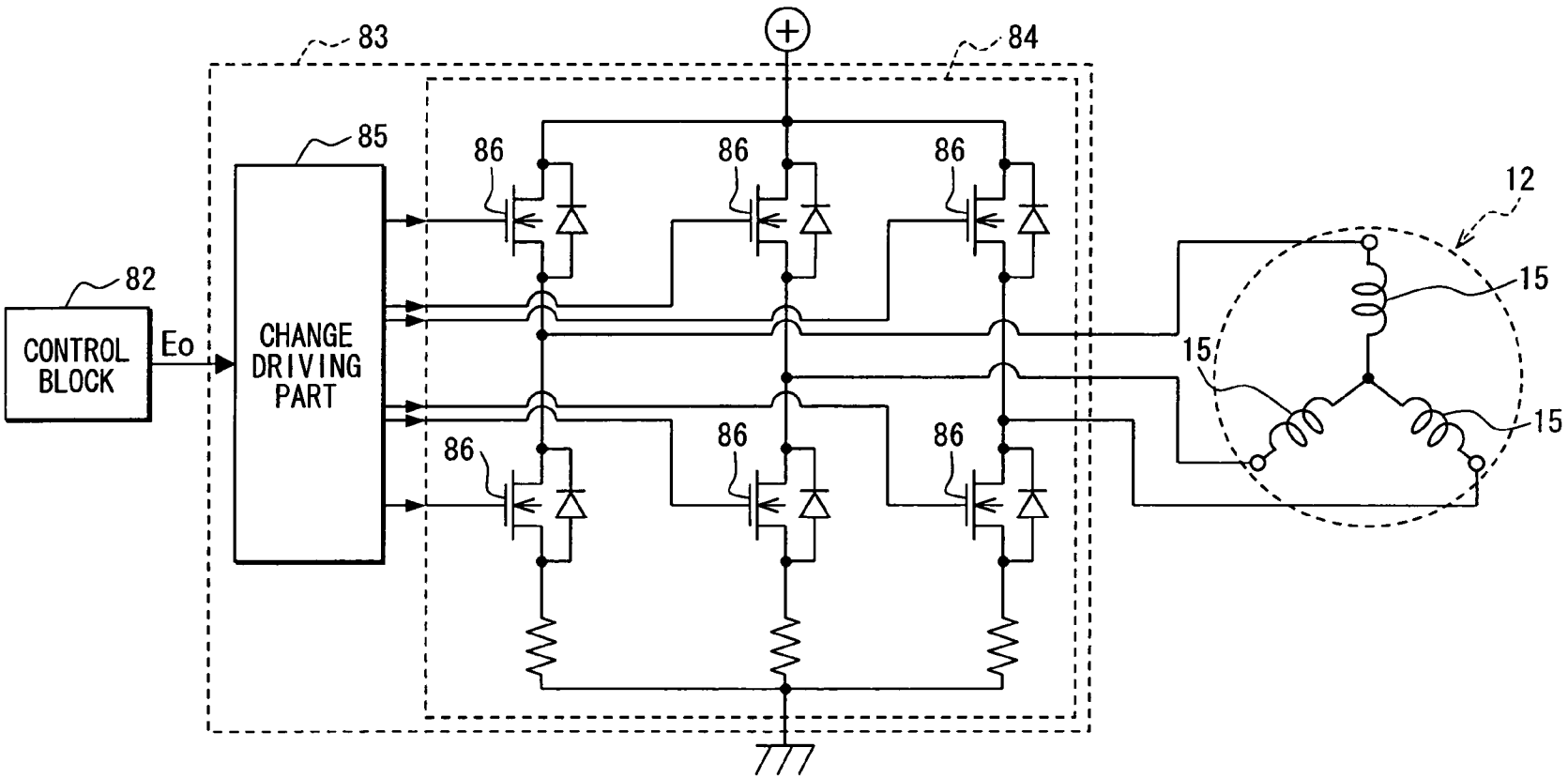
FIG. 9 is a block diagram showing an energization block.

As shown in FIG. 9, the energization block 83 has the inverter part 84 and the change driving part 85. In the inverter part 84 which constitutes the bridge circuit, a plurality of switching elements 86 are respectively connected to the coil 15 of the electric motor 12. Moreover, the control block 82 and each switching element 86 of the inverter part 84 are connected to the change driving part 85. The change driving part 85 performs pulse width modulation of the driving signal of each switching element 86 according to the energization instruction value Eo transmitted from the control block 82. As a result, since each switching element 86 is switched by the driving signal, the electric motor 12 is energized to rotate in the target rotation direction Dt.

Besides, in the present embodiment, the sign of the positive/negative, which expresses the direction of normal rotation direction or the reverse rotation direction of the target rotation direction Dt, is added to the duty ratio of the driving signal of each switching element 86, and this value is established as the energization instruction value Eo. Therefore, the duty ratio of the driving signal of each switching element 86 is determined from the absolute value of the energization instruction value Eo in the change driving part 85. Moreover, the ON/OFF-timing of the driving signal of each switching element 86 is determined from the sign of the energization instruction value Eo.

Figure 10:
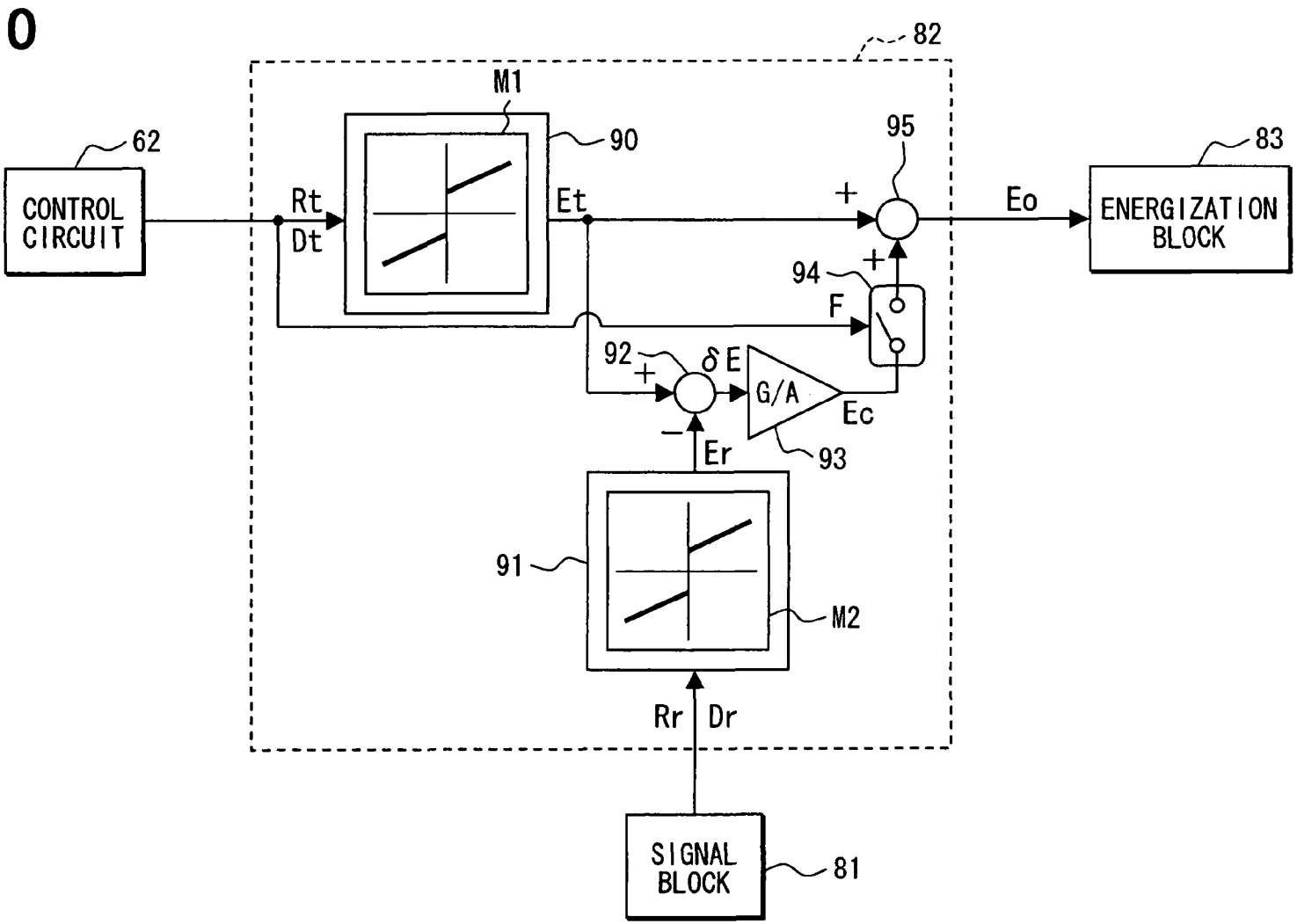
FIG. 10 is a block diagram showing a control block.

Next, the characterizing portion of the electric valve timing adjusting device 10 is explained in more detail. As shown in FIG. 10, the control block 82 has a targeted value calculation part 90, a result value calculation part 91, a subtraction part 92, a multiplication section 93, an invalid switch part 94, and an addition part 95.

The targeted value calculation part 90 stores a first conversion map M1 for computing the energization targeted value Et by converting the target rotation speed Rt. The targeted value calculation part 90 outputs the energization targeted value Et according to the target rotation speed Rt which is inputted to the first conversion map M1. On the first conversion map M1 of the present embodiment, the relationship between the target rotation speed Rt and the energization targeted value Et differs between the case where the target rotation direction Dt is the normal direction and the case where the target rotation direction Dt is the reverse direction.

Figure 11A:
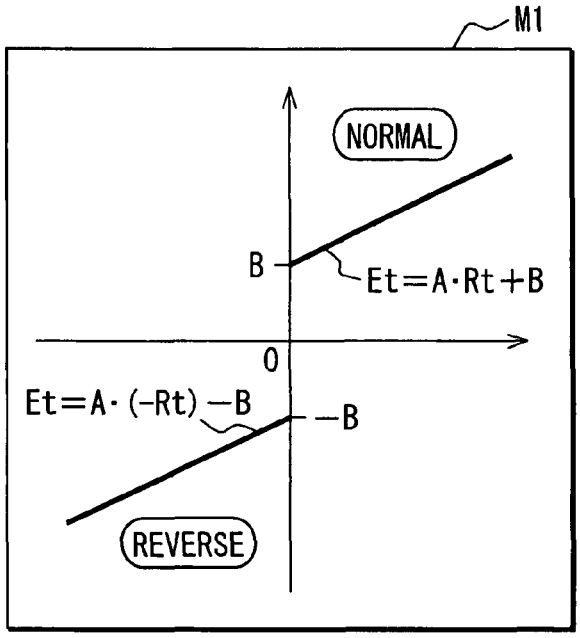
FIG. 11A and FIG. 11B are a first and a second conversion map.

The first conversion map M1 specifically defines the relationship according to the following transformation (1) as relationship in case the target rotation direction Dt is the normal rotation direction, as shown in FIG. 11 A. That is, when the target rotation direction Dt is the normal rotation direction, the energization targeted value Et is the linear expression of the target rotation speed Rt with an intercept "+B".

$$Et=A\times Rt+B \tag{1}$$

Moreover, the first conversion map M1 defines the relationship according to the following transformation (2) as relationship in case the target rotation direction Dt is the reverse rotation direction, as shown in FIG. 11 A. That is, when the target rotation direction Dt is the reverse rotation direction, the energization targeted value Et is the linear expression of the target rotation speed Rt with an intercept "−B".

$$Et=A\times(-Rt)-B \tag{2}$$

As shown in FIG. 10, the result value calculation part 91 stores the second conversion map M2 for computing the energization result value Er by converting the actual rotation speed Rr, and outputs the energization result value Er according to the input of the actual rotation speed Rr to the second conversion map M2. On the second conversion map M2 of the present embodiment, the relationship between the actual rotation speed Rr and the energization result value Er differs between the case where the actual rotation direction Dr is the normal direction and the case where the actual rotation direction Dr is the reverse direction.

Figure 11B:
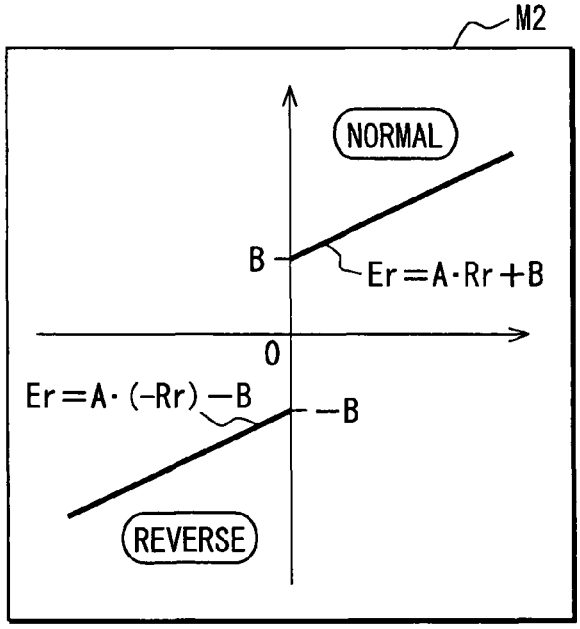
Figure 13A:
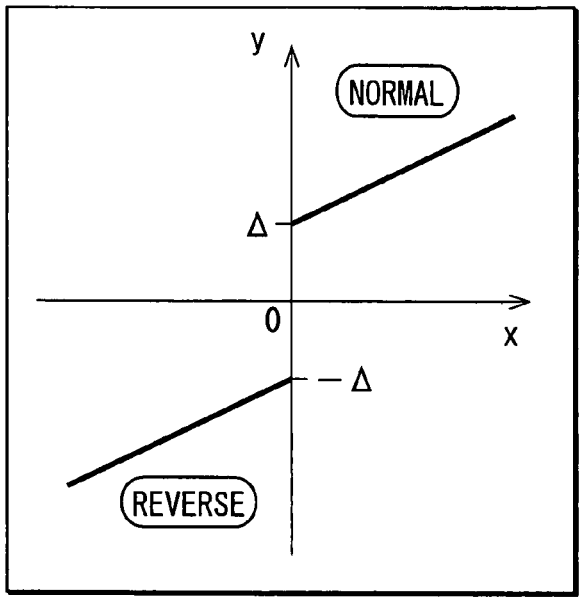
FIGS. 13A and 13B are maps for explaining a related art.
Figure 13B:
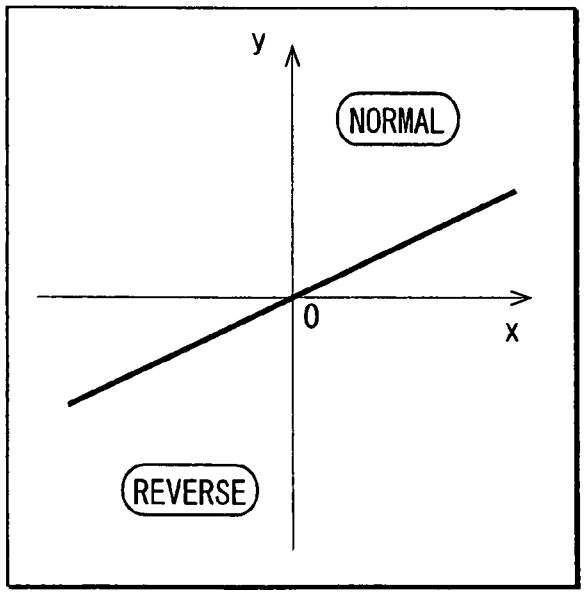

Specifically, the second conversion map M2 defines the relationship according to a transformation (3), when the actual rotation direction Dr is the normal rotation direction, as shown in FIG. 11B. Moreover, when the actual rotation direction Dr is the reverse rotation direction, the relationship is defined according to a transformation (4). That is, when the actual rotation direction Dr is the normal rotation direction, the energization result value Er is the linear expression of the actual rotation speed Rr with an intercept "+B". When the reverse rotation direction, the energization result value Er is the linear expression of the actual rotation speed Rr with an intercept "−B".

$$Er=A\times Rr+B \tag{3}$$

$$Er=A\times(-Rr)-B \tag{4}$$

As shown in FIG. 10, the subtraction part 92 computes difference δE by subtracting the energization result value Er from the energization target value Et. Moreover, the multiplication section 93 computes the feed back correction value Ec by performing the multiplication of control gain G/A to difference δE. Therefore, the feed back correction value Ec can be expressed by a following formula (5). Therefore, in the present embodiment where the positive/negative signs of the values Et, Er correspond to the directions Dt, Dr, as shown in FIG. 12, the feed back correction value Ec is obtained according to whether the direction Dt and the direction Dr are the same direction.

$$Ec=G/A\cdot\delta E=G/A\cdot(Et-Er) \tag{5}$$

When the target rotation direction Dt and the actual rotation direction Dr are the normal rotation directions (i.e., when the target rotation direction Dt is held in the normal rotation direction), the feed back correction value Ec can be expressed by a following formula (6) which is derived from the above formulas (1), (3), and (5). Moreover, when both the target rotation direction Dt and the actual rotation direction Dr are the reverse rotation directions (i.e., when the target rotation direction Dt is held in the reverse rotation direction), the feed back correction value Ec can be expressed by a following formula (7) which is derived from the above formula (2), (4), and (5).

$$Ec=G\cdot(Rt-Rr) \tag{6}$$

$$Ec=G\cdot\{(-Rt)-(-Rr)\} \tag{7}$$

When the target rotation direction Dt is the normal rotation direction and the actual rotation direction Dr is the reverse rotation direction, namely, when the target rotation direction Dt is changed into the normal rotation direction from reverse rotation, the feed back correction value Ec can be expressed by a following formula (8) which are derived from the above formulas (1), (4), and (5). Moreover, the target rotation direction Dt is the reverse rotation direction, and when the actual rotation direction Dr is the normal rotation direction, namely, when the target rotation direction Dt is changed in the reverse rotation direction from the normal rotation direction, the feed back correction value Ec can be expressed by a following formula (9) which is derived from the above formulas (2), (3), and (5).

$$Ec=G\cdot\{Rt-(-Rr)\}+2B\cdot G/A \tag{8}$$

$$Ec=G\cdot\{(-Rt)-Rr\}-2B\cdot G/A \tag{9}$$

Here, in each formula (6)-(9), the multiplication values (Rt−Rr), {(−Rt)−(−Rr)}, {Rt−(−Rr)}, and {(−Rt)−Rr} serve as the difference between the rotation speed Rt and the rotation speed Rr, taking Direction Dt and Dr into consideration. Therefore, when the directions Dt and Dr are the same, or when they differ, the feed back correction value Ec corresponding to the difference between the target rotation speed Rt and the actual rotation speed Rr can be is obtained.

As shown in FIG. 10, the invalid switch part 94 is a non-contact relays, such as an electromagnetic relay and a semiconductor switch, and is provided on a line through which the feed back correction value Ec is transferred from the multiplication section 93 to the addition part 95. The invalid switch part 94 makes the feed back correction value Ec effective or non-effective by turning on or turning off according to the status of the instruction flag F given from the control circuit 62.

Specifically, when the instruction flag F is ON by maintaining the target rotation direction Dt, the invalid switch part 94 turns on and, the feed back correction value Ec become effective. Thereby, the feed back correction value Ec expressed by the above formulas (6) or (7) is transmitted to the addition part 95. Meanwhile, when the instruction flag F is established as OFF by change of the target rotation direction Dt, the invalid switch part 94 turns off and the feed back correction value Ec is non-effective. Thereby, the transfer of the feed back correction value Ec to the addition part 95 is intercepted. Besides, in the present embodiment, the transfer interception becomes equivalent to transmitting the feed back correction value Ec of the zero value to the addition part 95.

The addition part 95 determines the energization instruction value Eo by adding the feed back correction value Ec (including the zero value) to the energization target value Et and correcting the value Et. Thereby, at the time of maintenance of the target rotation direction Dt, as shown in FIG. 12, the sum of the energization target value Et expressed by the formula (1) or (2) and the feed back correction value Ec expressed by the formula (6) or (7) is supplied to the energization block 83 as the energization instruction value Eo. Therefore, at the time of maintenance of the target rotation direction Dt, the feedback control is performed to the energization of the electric motor 12. Meanwhile, at the time of change of the target rotation direction Dt, as shown in FIG. 12, the energization target value Et expressed by the formula (1) or (2) is substantially supplied to the energization block 83 as an energization instruction value Eo. Therefore, at the time of change of the target rotation direction Dt, with respect to the energization of the electric motor 12, an open loop control is performed at the same time when the feedback control is suspended.

Besides, as shown in FIG. 12, the energization instruction value Eo at the time of changing the target rotation direction Dt shifts from the hold value Eo before changing. Then, the control circuit 62 of the present embodiment establishes the target rotation speed Rt so that difference of the energization instruction value Eo may become below a predetermined permissible limit E at the time of changing the target rotation direction Dt.

As mentioned above, according to the electric valve timing adjusting device 10, as shown in FIG. 12, the feed back correction value Ec at the time of changing the target rotation direction Dt is increased by the value corresponding to a sum of the intercept values B in the maps M1 and M2 in the positive direction or the negative direction. However, as shown in FIG. 12, at the time of changing the target rotation direction Dt, the feed back correction value Ec is non-effective and is not reflected to the energization instruction value Eo, so that the amount of energization to the electric motor 12 is not increased. And even if it does not use the map properly in the time of holding and changing the target rotation direction Dt, the operation can be performed only by processing in which feedback control is suspended by cancellation of the feed back correction value Ec. From these things, the simplification of processing and the simplification of hard structure required for rotation of the electric motor 12 are realizable with the reduction of energy consumption.

In addition, the frequency of change of the target rotation direction Dt becomes less than the frequency of maintenance of the target rotation direction Dt. Therefore, the influence by canceling the feed back correction value Ec and switching to open loop control from feedback control can be restrained. Moreover, since the target rotation speed Rt is established so that difference of the energization instruction value Eo may become below the permissible limit E, the influence by the switching of the control mode can be restricted.

Other Embodiments

The present invention is limited to the above-mentioned embodiment, and can be applied to various embodiments within a scope of the invention.

For example, the function of the control block 82 may be realized by executing the program with the microcomputer.

Moreover, the target rotation speed Rt and the target rotation direction Dt may be established by the drive circuit 80 based on other information supplied to the drive circuit 80 from the control circuits 62, such as the target variation of the rotation speed of the electric motor 12, and the number of rotations of the internal combustion engine.

Furthermore, based on the target rotation direction Dt and the actual rotation direction Dr, the drive circuit 80 may determine the cancellation of the feed back correction value Ec.

In addition, the target rotation speed Rt, the target rotation direction Dt, and the instruction flag F may be inputted into the drive circuit 80 from the control circuit 62 by the respectively separate signal or the two kinds of signals. Moreover, the fixed value decided previously may be sufficient as the target rotation speed Rt at the time of change of the target rotation direction Dt.

Moreover, in addition, the motors other than the brush loess motor may be adopted. Besides, the structure of the energization block 83 can be suitably changed according to the kind of electric motor 12.

Furthermore, in addition, the phase-changing unit is employable suitably as long as the valve timing is adjustable by use of an electric motor.

What is claimed is:

1. A valve timing controller for an internal combustion engine, the valve timing controller adjusting a valve timing of at least one of an intake valve and an exhaust valve by driving an electric motor in a normal rotation direction or a reverse rotation direction, comprising:

a drive circuit for performing a feedback control of an energization to the electric motor based on a target rotation speed and an actual rotation speed of the electric motor so as to rotate the electric motor to a target rotation direction, wherein the drive circuit stops the feedback control at the time of changing the target rotation direction.

2. A valve timing controller according to claim 1, further comprising a target set circuit for establishing the target rotation speed and the target rotation direction.

3. A valve timing controller according to claim 2, wherein the drive circuit stops the feedback control and performs an open loop control of the energization to the electric motor based on the target rotation speed at the time of changing the target rotation direction.

4. A valve timing controller according to claim 3, wherein the drive circuit includes:

a target value calculation means for calculating an energization target value corresponding to the target rotation speed;

a correction value calculation means for calculating a feedback correction value corresponding to a difference between the target rotation speed and the target rotation direction;

a correction means for correcting the energization target value with the feedback correction value to determine an energization instruction value;

an energization means for energizing the electric motor according to the energization instruction value; and an invalid means for invalidating the feedback correction value at a time of changing the target rotation direction.

5. A valve timing controller according to claim 4, wherein the target set circuit instructs an invalidation of the feedback correction value to the invalid means at a time of changing the target rotation direction.

6. A valve timing controller according to claim 4, wherein the target set circuit establishes the target rotation speed in such a manner that a difference of the energization instruction value after the target rotation direction is changed is not more than a permissible limit value at a time of changing the target rotation direction.

7. A valve timing controller according to claim 4, wherein the correction value calculation means calculates the feedback correction value based on a difference between the energization target value obtained by converting the target rotation speed on a first conversion map and the energization target value obtained by converting the actual rotation speed on a second conversion map.

8. A valve timing controller according to claim 7, wherein the target value calculation means calculates the energization target value by converting the target rotation speed on the first conversion map, and the correction value calculation means utilizes the energization target value which is calculated by the target value calculation means when calculating the feedback correction value.

9. A valve timing controller according to claim 7, wherein the energization target value is offset into the target rotation direction with respect to a zero value of the target rotation speed on the first conversion map, and the energization result value is offset into the actual rotation direction of the electric motor with respect to a zero value of the actual rotation speed on the second conversion map.

* * * * *